United States Patent [19]

Gambello

[11] Patent Number: 4,932,538

[45] Date of Patent: Jun. 12, 1990

[54] FIXTURE SUPPORT WALL PANEL

[76] Inventor: Vincent J. Gambello, 90 Prospect Ave., Apt. 3-D, Hackensack, N.J. 07601

[21] Appl. No.: 215,598

[22] Filed: Jul. 6, 1988

Related U.S. Application Data

[63] Continuation of Ser. No. 785,010, Oct. 7, 1985, abandoned.

[51] Int. Cl.[5] ..... A47F 5/08

[52] U.S. Cl. ..... 211/87; 211/59.1; 248/220.4; 248/222.2; 248/225.1

[58] Field of Search ..... 211/57.1, 59.1, 87, 211/183, 189, 194, 195; 40/124.4; 248/220.4, 222.2, 225.1

[56] References Cited

U.S. PATENT DOCUMENTS

| | | | |
|---|---|---|---|
| 2,223,680 | 12/1940 | Fischer et al. | 248/298 |
| 2,551,539 | 5/1951 | Horton | 248/220.3 |
| 2,614,701 | 10/1952 | Mapson | 211/87 |
| 2,649,968 | 8/1953 | Rice | 211/189 |
| 2,940,606 | 6/1960 | Kurnitz | 211/183 |
| 2,964,859 | 12/1960 | Storer | 40/618 |
| 2,966,754 | 1/1961 | Orkin | 40/618 |
| 2,971,653 | 2/1961 | Shaw | 248/220.3 |
| 3,045,961 | 7/1962 | Cygan | 248/221.2 |
| 3,112,912 | 12/1963 | Alvarez | 248/221.2 |
| 3,172,540 | 3/1965 | Berge | 248/220.3 |
| 3,191,777 | 6/1965 | Willits, Jr. | 211/87 |
| 3,235,218 | 2/1966 | Graham | 248/220.3 |
| 3,268,195 | 8/1966 | Hoffman | 248/220.3 |
| 3,306,564 | 2/1967 | Nickel | 248/220.3 |
| 3,322,287 | 5/1967 | Ragir | 211/87 |
| 3,367,509 | 2/1968 | Cabe | 211/87 |
| 3,502,222 | 3/1970 | Crafoord | 248/224.2 |
| 3,516,552 | 6/1970 | Salava | 248/220.3 |
| 4,008,872 | 2/1977 | Thompson | 248/224.2 |
| 4,093,168 | 6/1978 | Buril | 211/57.1 |
| 4,420,087 | 12/1983 | Johns | 248/220.3 |
| 4,450,970 | 5/1984 | Shepherd | 248/222.2 |
| 4,573,513 | 3/1986 | Small et al. | 211/194 |
| 4,589,557 | 5/1986 | Bollman | 211/87 |
| 4,607,753 | 8/1986 | Radek | 211/87 |

FOREIGN PATENT DOCUMENTS

| | | | |
|---|---|---|---|
| 245197 | 2/1966 | Austria | 211/87 |

*Primary Examiner*—Robert W. Gibson, Jr.
*Attorney, Agent, or Firm*—Weingram & Zall

[57] ABSTRACT

A modular display panel uses a series of molded trays connected to each other by an integrally molded continuous flange matrix perpendicular to the open edges or rims of the tray side walls; each tray consisting of a large flat plane connected at less than all the side walls, at least one side wall being open for the full length of one side, plus a small portion of the length of two adjacent side walls, creating an opening through which standard commercial slat wall accessories can pass. A pegboard version apertures the slat wall version or forms a series of trays having pegboard apertures therein. The flange matrix provides built in stand offs for mounting the panel.

4 Claims, 3 Drawing Sheets

FIXTURE SUPPORT WALL PANEL

This is a continuation of co-pending application Ser. No. 06/785,010 filed on Oct. 7, 1985 now abandoned.

BACKGROUND OF THE INVENTION

1. Field of the Invention

This invention relates to the modularized mounting panel field and specifically to the use of sub-panels which are formed in a modularizable panel as an integral unit in an injection molding process. The sub-panels, which may be in the shape of rectangles, have their bottom portion open to allow for slot wall mounting brackets to fit into the panel. Vertical grooves which separate sub-panels in all directions act as an integral stand-off strips for mounting the module to the wall. Fastening holes are incorporated in the vertical grooves for mounting with screws or molly bolts so that each panel can be mounted to the wall.

The sub-panels of the slat wall version may be utilized in a PEGBOARD mounting system mode.

2. Description of the Prior Art

The prior art contains many examples of display board and other devices which are first mounted and are then capable of supporting various articles, messages, etc. for display or advertising purposes. In general, such devices have been limited in their application because they require not only special mounting boards, but special hook or other hardware to connect onto the mounting board. The need for commonality of parts and standardization is, of course, apparent in the display material field. The applicant believes that, in general, the field has standardized on the well-known PEGBOARD mounting system and slat wall configurations. Mounting accessories capable of being utilized on the PEGBOARD mounting system and the slat wall configurations are widely available. Accordingly, while the prior art is generally adequate for the applications shown therein, such prior art has had limited commercial application because of specialized requirements to use the combinations shown therein. Nickel U.S. Pat. No. 3,306,564, for example discloses a perforated hard board configuration having vertical and horizontal grooves or channels to provide some decorative advantages in hiding unused pegboard holes. Johns U.S. Pat. No. 4,420,087 discloses a combined mounting configuration which requires a variety of special apparatus to connect and to utilize same.

SUMMARY OF THE INVENTION

The present invention relates to display and modular supporting system, and more particularly to a supporting system for mounting a variety of desired modules on supporting structure. The display panel of the present invention may utilize (in a "slat wall" version) a series of square or rectangular molded trays connected to each other by an integrally molded contiguous flange matrix perpendicular to the open edges or rims of the tray side walls. Each tray consists of a large square or rectangular flat plane connected to only three side walls, the fourth wall being open for the full length of one side plus a small portion of the length of the two adjacent side walls, thereby creating an opening through which standard commercial salt wall accessories can pass.

In the pegboard version, either the slat wall version is apertured, or the series of square or rectangular molded trays connected to each other by the integrally molded contiguous flange matrix, perpendicular to the open edges or rims of the tray side walls, have pegboard apertures therein. Each tray consists of a large square or rectangular flat plane which is connected to at least two side walls. The apertures in each large flat plane are integrally molded as holes or slots therein of appropriate size and spacing to accommodate pegboard accessories. The flange matrix provides a built-in stand-off which allows the PEGBOARD mounting system accessories to pivot through the holes in the large flat plane.

Accordingly, it is an object of the invention to provide a light weight display panel with very high strength using numerous ridges and flanges designed into the unit. Another object of the invention is to provide a light weight display panel with very high strength with ordered sub-panels, the bottom of each sub-panel opens to allow for sliding of slot wall brackets so that when panels are lined up, a continuous horizontal slot is formed so that brackets can go from one panel to the other.

Another object of the invention is to provide a light weight display panel with very high strength having deep vertical mounting strips resulting in adequate room behind each sub-panel for PEGBOARD mounting system mounting brackets to be inserted. Still another object of the invention is to provide a light weight display panel with very high strength which eliminates the requirement for stand-off or furring strips to be mounted behind the display panel to provide the necessary separation of the display panel and the supporting wall to insert the slat boards or the PEGBOARD mounting system brackets.

A further object of the invention is to provide a light weight display panel with very high strength having additional strength over presently existing items such as pegboards or slat boards by providing a short distance between the vertical struts thereby preventing the bowing of the entire panel by isolating and limiting the points of stress and distributing them over the entire panel in a uniform way without bowing.

Another object of the invention is to provide a light weight display panel with very high strength having in each sub-panel a cantilevered bottom to allow for deformation to distribute points of excessive stress. A further object of the invention is to provide a light weight display panel with very high strength which, with its ribs and sub-panels, forms a torque resistant matrix.

Still another object of the invention is to provide a light weight display panel with very high strength designed for injection molding so that it can be manufactured as a single unit resulting in improved manufacturing tolerances because all of the surfaces are created in a single molding operation.

An additional object of the invention is to provide a light weight display panel with very high strength having a highly flexible arrangement that can be formed from small integral sections resulting in easy manufacture and shipment. A further object of the invention is to provide a light weight display panel with very high strength having sub-panels that can be made in relatively small unit quantities so that an individual workman, alone, can assemble a large display by using several sub-panel sets..

Another object of the invention is to provide a light weight display panel with very high strength where no prior surface preparation is necessary for mounting the panels of the invention. Still another object of the invention is to provide a light weight display panel with very high strength which eliminates the need for stand-off strips or furring strips and minimizes damage to the underlying wall surface to allow the units of the invention to be removed relatively easily without undue damage to the wall surface.

A further object of the invention is to provide a light weight display panel with very high strength formed of plastic in an injection molding operation, which can be bonded adhesively to a larger plastic backing board.

Another object of the invention is to provide a light weight display panel with very high strength which can be used with all conventional standard display mounting apparatus such as pegboard accessories and brackets and/or slot brackets, without the need for special mounting brackets or other equipment.

A further object of the present invention is to provide a light weight display panel with very high strength which is simple to install without the need for skilled carpentry work.

An additional object of the invention is to provide a light weight display panel with very high strength which can have an indefinite number of styling variations simply by changing the size and shape of the sub-panels and/or the number, size and shape of holes or slots in the sub-panel.

A further object of the invention is to provide a light weight display panel with very high strength having the ability to form an open slot in the slot wall version at any of the side walls so that a continuous slot can be made available in any direction or in a number of different directions.

BRIEF DESCRIPTION OF THE DRAWINGS

The above and other objects and advantages of the invention will become apparent to those skilled in the art from the review of the following detailed description and accompanying drawings in which.

DETAILED DESCRIPTION OF THE INVENTION

Figure 1:
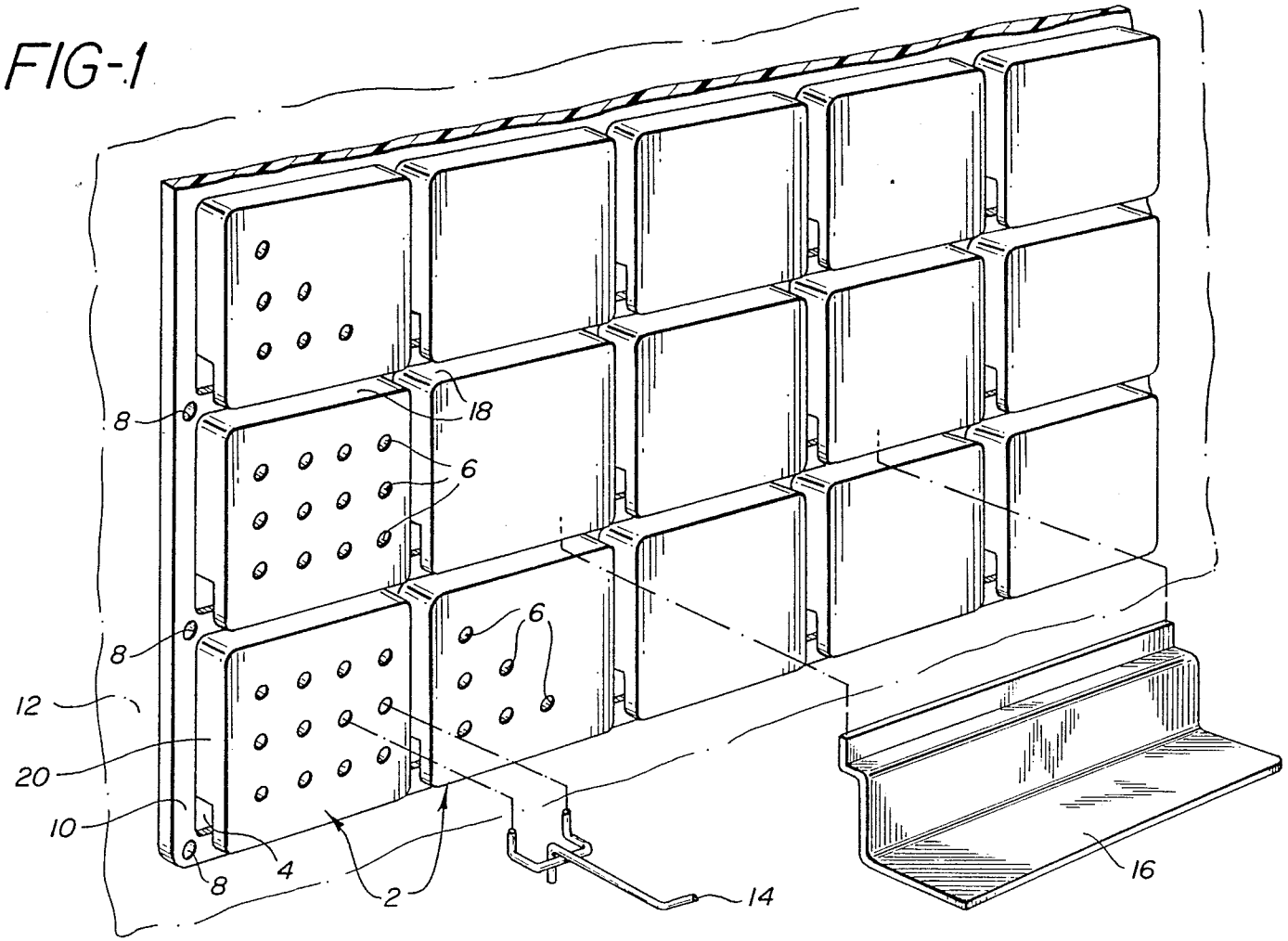
FIG. 1 is a perspective view of an embodiment of the invention which incorporates both the slat wall configuration and the pegboard configuration.

As shown in FIG. 1, numeral 12 denotes a wall panel or other surface on which it is desired to display items. The invention includes a plurality of square shaped raised portions, sub-panels, or pockets, 2. These raised portions have slots formed in the bottom wall thereof, such slots shown at 4, for example. In addition, the portions 2 have holes 6 formed therein. The square portions 2 are mounted on a base 10 and may be formed integrally therewith in manufacture. Holes such as 8 are formed in the base 10 to mount the unit on the wall in standard configuration using screws, bolts, etc. In addition, surface 12 may be of a material suitable for use with adhesive bonding so that no use will be made of the mounting holes 8.

Figure 2:
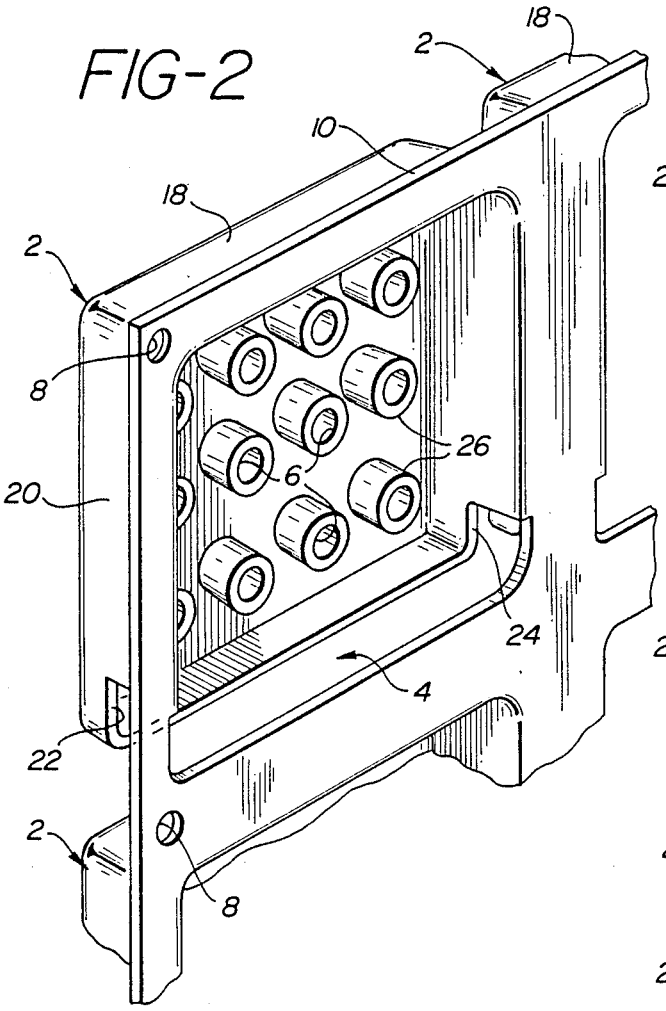
FIG. 2 is a perspective view of the rear of the configuration shown in FIG. 1.

Illustratively, numeral 14 denotes a PEGBOARD mounting system hook and numeral 16 denotes a slat wall shelf. As will be apparent, the pegs of the PEGBOARD mounting system hook 14 interfit into holes 6 as desired. Note that the height of the rectangular configurations above base 10 is sufficient to provide space for PEGBOARD mounting system connectors 14 to interfit therewith. In the same manner, slat wall configuration of shelf 16 interfits into slot 4 and is supported by the top of the raised portion of rectangular configuration 2. In FIGS. 1 and 2, the top portion of the raised surface is denoted by numeral 18.

FIG. 2 is another perspective view of the construction of the invention from the rear of the rectangular panel. As shown therein, the base 10 has a mounting hole 8 formed therein. The rectangular mounting panel 2 is raised for thickness 20 above the base 10. Slot 4 is formed in the bottom wall of thickness 20 along the entire length of the wall plus small portions 22 and 24 of the two side walls. In thin wall moldings PEGBOARD mounting system holes 6 may be strengthened by having cylindrical support portions 26 formed therein. In this way, the proper thickness is built up to support the forces generated by any PEGBOARD mounting system accessory such as hook 14 of FIG. 1. Again, the thickness 20 of the portion 2 is sufficient to provide adequate room behind holes 6 to allow the pegs of the PEGBOARD mounting system accessory 14, ample room for connection, disconnection and support.

Figure 3:
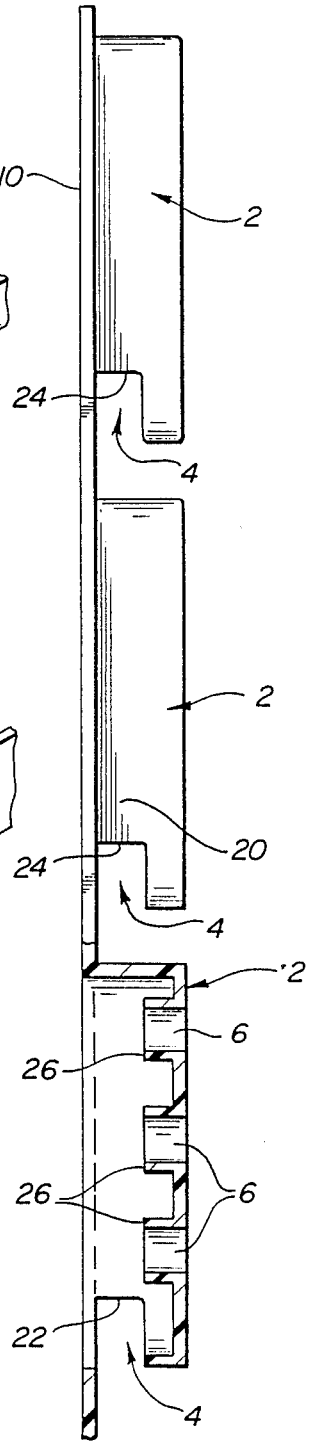
FIG. 3 is an end view, partially in section of the embodiment of FIG. 1.

FIG. 3 is an end view, partially in section, of the embodiment of the invention shown in FIG. 1. As shown in FIG. 3, several of the rectangular panels 2 are mounted one on top of the other formed integrally on base 10. The slat wall slots 4 are formed in the bottom surfaces of the panels 2. The PEGBOARD mounting system apertures 6 are shown in section in one of the panels 2 along with the supporting cylindrical extensions of aperatures 6 at numeral 26.

Figure 4:
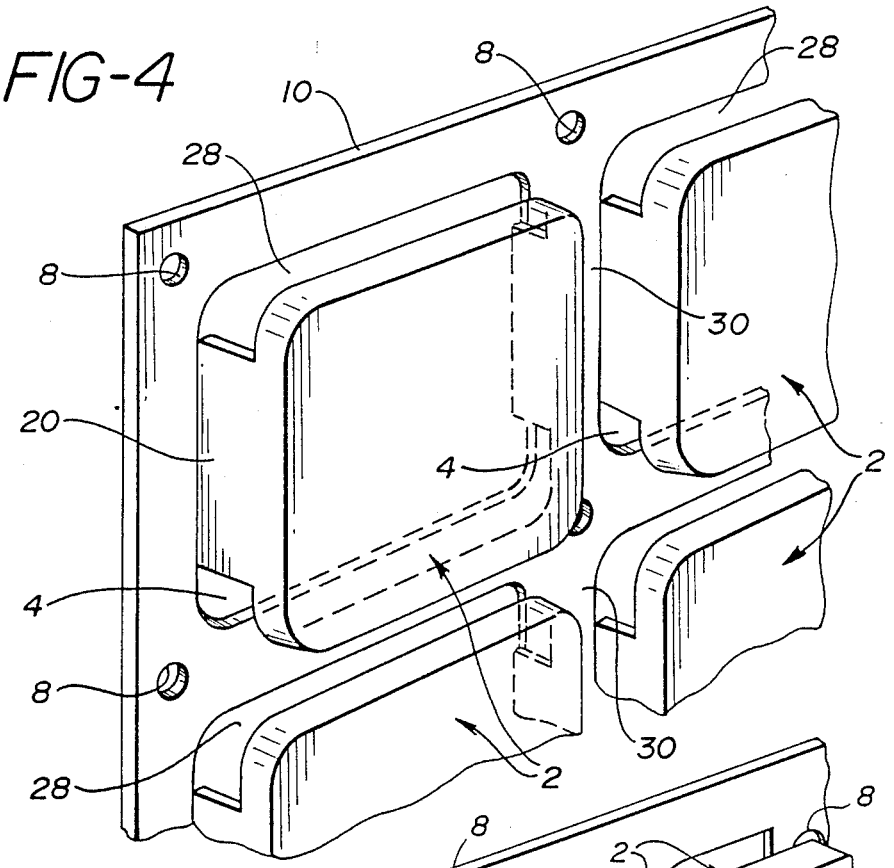
FIG. 4 is a front view of another embodiment of the invention.

FIG. 4 shows a perspective view of another embodiment of the invention. In this embodiment, the top and bottom of the supporting panel extensions are both open so that two slat wall slots 4 and 28 are thus formed. The slots 4 and 28 are formed by the space between the base 10 and the panel portions 2. Numeral 30 in this configuration notes the connecting portion of base 10 which connects adjacent units of the rectangular panels 2.

In the embodiment shown in FIG. 4, PEGBOARD mounting system apertures 6 are not shown. Of course, a PEGBOARD mounting system version of this embodiment can also be made by locating apertures 6 therein with or without the extra structural support cylindrical extensions 26 of FIG. 2.

Figure 5:
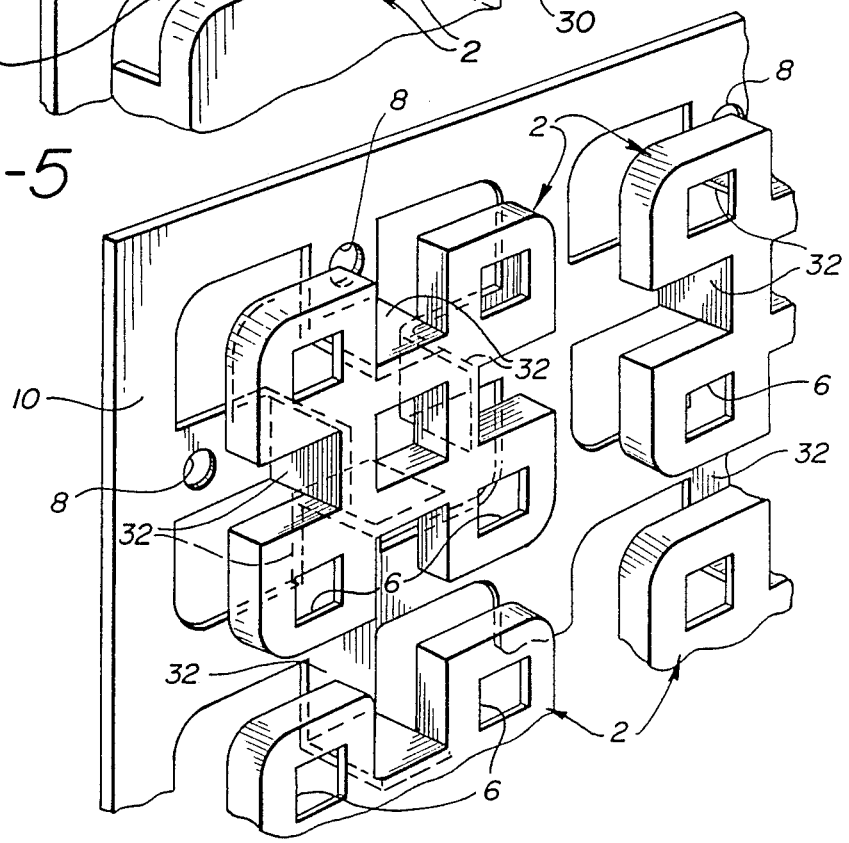
FIG. 5 is a perspective view of another embodiment of the invention.

FIG. 5 shows another embodiment of the invention having four slots provided. As shown in this figure, the mounting of the panel 2 on the base 10 can be done by a centrally located mounting 32. Again the invention is not limited to any specific configuration or shape of panels 2, apertures 6 or to any number of slots, 4.

As will now be seen, the invention provides an almost unlimited number of combinations of possibilities of slots and holes in which one can display using presently available slat wall or PEGBOARD mounting system accessories. The device is highly suitable for injection molding and can be molded in combinations of panels such that the display wall can be formed of a number of panels either adhesively bonding them to a base or through the use of the apertures for screws, molly bolts, etc.

As further modifications may be made in the invention without departing from the spirit and scope thereof, the foregoing detailed specification is intended as illustrative and my invention is defined in the appended claims.

I claim:

1. A display panel comprising a plurality of elongate vertical and horizontal strips connected together in a grid array; flat sub-panels disposed on said strips; said sub-panels affixed to said strips via at least two walls formed between said sub-panels and said strips for supporting said sub-panels at a distance from the surface of said strips; said sub-panels each being apertured so as to receive accessories in said apertures; said apertures comprising a slot formed between each of said sub-panels and said strips; said slot permitting access to the entire underside of said sub-panel; such slots and said walls of vertically adjacent panels being formed in aligned relation to each other for supporting display devices.

2. A mounting apparatus for article display devices comprising:

a continuous sheet having formed therein a plurality of raised planar display device supporting surfaces including a slotted means therein for receiving a portion of display devices and support means formed beneath said slotted means for supporting a portion of display devices;

said slotted means consisting of an aperture extending along the entire lower portion of said planar display device supporting surface for permitting access to the entire underside of said planar display device supporting surface;

display devices being supported in said slotted means by adjacent supporting surfaces as a function of the size of the display devices.

3. A mounting apparatus for article display devices comprising:

a plurality of pairs of raised planar display device supporting surfaces embossed on a continuous sheet; each pair of said supporting surfaces including a slotted means formed in one element of a pair for receiving a portion of a display device and support means formed in the other element of said pair beneath said slotted means for supporting a portion of a display device;

said slotted means consisting of an aperture permitting access to the entire underside of said planar display device supporting surface;

the display device being capable of being supported by a plurality of adjacent pairs of supporting surfaces as a function of the size of said display devices.

4. A mounting apparatus for article display devices comprising:

a plurality of pairs of raised planar display device supporting surfaces embossed on a continuous sheet; each of said pairs of supporting surfaces including an upper supporting surface and a lower supporting surface; slotted means formed in said upper supporting surface for receiving and supporting a portion of said display device;

said slotted means consisting of an aperture extending along the entire lower portion of said upper supporting surface for permitting access to the entire underside of said planar display device supporting surface;

said display device being capable of being supported by a plurality of adjacent pairs of supporting surfaces as a function of the size of said display device.

* * * * *